United States Patent [19]

Deverrewaere

[11] 4,321,658

[45] Mar. 23, 1982

[54] HEADLAMPS FOR VEHICLES, AND LIGHT UNITS FOR SUCH HEADLAMPS

[75] Inventor: Alain Deverrewaere, La Varenne, France

[73] Assignee: Cibie Projecteurs, Bobigny, France

[21] Appl. No.: 94,410

[22] Filed: Nov. 15, 1979

[30] Foreign Application Priority Data

Nov. 24, 1978 [FR] France ..... 78 33260

[51] Int. Cl.[3] ..... F21V 11/06

[52] U.S. Cl. ..... 362/292; 362/306; 362/344

[58] Field of Search ..... 362/21, 61, 80, 279, 362/290, 292, 306, 311, 344, 390, 804

[56] References Cited

U.S. PATENT DOCUMENTS

| | | | |
|---|---|---|---|
| 1,921,069 | 8/1933 | Buchanon | 362/292 |
| 2,001,030 | 5/1935 | Kurtz | 362/306 |
| 3,032,646 | 5/1962 | Chieger | 362/292 |
| 3,170,635 | 2/1965 | Curtin | 362/344 X |
| 3,610,919 | 10/1971 | Winpisinger | 362/344 X |
| 4,153,928 | 5/1979 | Speedy | 362/80 X |
| 4,197,574 | 4/1980 | Weiss | 362/390 X |

FOREIGN PATENT DOCUMENTS

| | | | |
|---|---|---|---|
| 422,859 | 1/1935 | United Kingdom | 362/21 |

*Primary Examiner*—Peter A. Nelson
*Attorney, Agent, or Firm*—Alan H. Levine

[57] ABSTRACT

A headlamp has a shell containing a bulb and reflector. The shell has a front opening which is closed by a glass front lens, and a planar plastics protective screen. If the lens should be broken, the screen will normally prevent broken glass and other contaminants from reaching and damaging the reflector.

9 Claims, 2 Drawing Figures

HEADLAMPS FOR VEHICLES, AND LIGHT UNITS FOR SUCH HEADLAMPS

BACKGROUND

1. Field of the Invention

This invention relates to headlamps for vehicles, and to light units for such headlamps; the term 'light unit' is used to denote an assembly of a reflector and a lens, which, as will become clear, must be releasably held together for the present invention to be applicable.

2. The Prior Art

There have been various forms of headlamps for vehicles:

(1) The main headlamps on old vehicles and auxiliary headlamps (e.g. anti-fog or long-range headlamps) of modern vehicles comprise a shell which is mounted outside the bodywork of the vehicle, and encloses the optical system (lamp and reflector) and is formed with a large light-transmitting opening, the opening being closed by a glass lens. The lens hermetically seals the headlamps and often also has an optical diffusing effect (diffusing ribs);

(2) The main headlamps on modern vehicles are fitted into recesses formed in the vehicle body. In their simplest form, these lamps comprise a reflector, usually of dished sheet-metal, having an opening covered by a lens used for sealing and, if required, for diffusion. This structure is normally called a "light unit". In some cases, an intermediate ring is disposed between the lens and reflector, in order to have a greater distance between the lens and the reflector.

(3) In some vehicles, light units are mounted in special compartments or shells formed with a light-transmitting aperture closed by a lens. The compartments or shells may or may not be integral with the vehicle body.

In all cases, the lens has a main flat or slightly convex part and a peripheral mounting zone which bears against an edge of the shell or the reflector, around the front aperture thereof. In the present case, the term "shell" should be taken in its widest sense to include separate shells, reflectors, and compartments of the vehicle body.

In all existing systems, the entire optical system, including the reflector, has to be replaced if the lens breaks as a result of a local impact. The reason is that pieces of glass from the broken lens enter the headlamp and some inevitably remain there, in spite of the most careful cleaning, and rapidly damage the optical system. Another result of a broken lens is that water vapour and dust enter the reflector and rapidly damage its surface.

For obvious economic reasons, however, it would be desirable to replace only the lens, while re-using the other components, especially the reflector, which is often the most expensive part of the headlamp.

It is an object of the invention to provide a headlamp in which the reflector need not be replaced if the lens should be broken.

SUMMARY OF THE INVENTION

According to one aspect, the invention provides, in a motor vehicle headlamp comprising a shell having a front opening, means within the shell for projecting a beam of light through the front opening, and a lens which closes the front opening, the lens having a peripheral mounting zone, and the front opening of the shell being encircled by a portion of the shell against which the mounting zone of the lens is fixed, the improvement comprising a strong screen which is permeable to light, which screen lies behind the lens, and closes off the front opening of the shell, the screen having a portion bordering the opening, which portion is received between the mounting zone of the lens and the portion of the shell, whereby, even if the lens should be broken, the interior of the shell is still closed off by the screen from broken glass and other contaminants.

Preferably, the part of the screen which closes the opening of the shell is planar, at least on the side of the screen facing the lens. This helps to ensure that particles of broken glass from the lens are not retained on the screen. This can be further ensured by arranged the screen vertically or near vertically.

The invention also extends to a prefabricated assembly of a lens and a screen for use in a vehicle headlamp having a shell with a front opening, and means within the shell for projecting a beam of light through the front opening, the assembly being for closing the front opening, and the screen being of a strong material which is permeable to light, and being attached to the rear of the lens, for closing the front opening, even if the lens should be broken .

The invention also extends to a light unit or assembly for use in a vehicle headlamp, which assembly comprises a reflector having a front opening, a strong transparent or translucent screen, and a front lens, the front opening of the reflector being closed off by the screen, even if the lens should be broken, the reflector, the screen and the lens each having a portion bordering the front opening, and the portion of the screen being received between the portions of the lens and the reflector.

BRIEF DESCRIPTION OF THE DRAWINGS

The invention may be carried into practice in various ways, but one specific embodiment will now be described by way of example, with reference to the accompanying drawings, in which.

DETAILED DESCRIPTION OF THE PREFERRED EMBODIMENT

Figures 1, 1A:
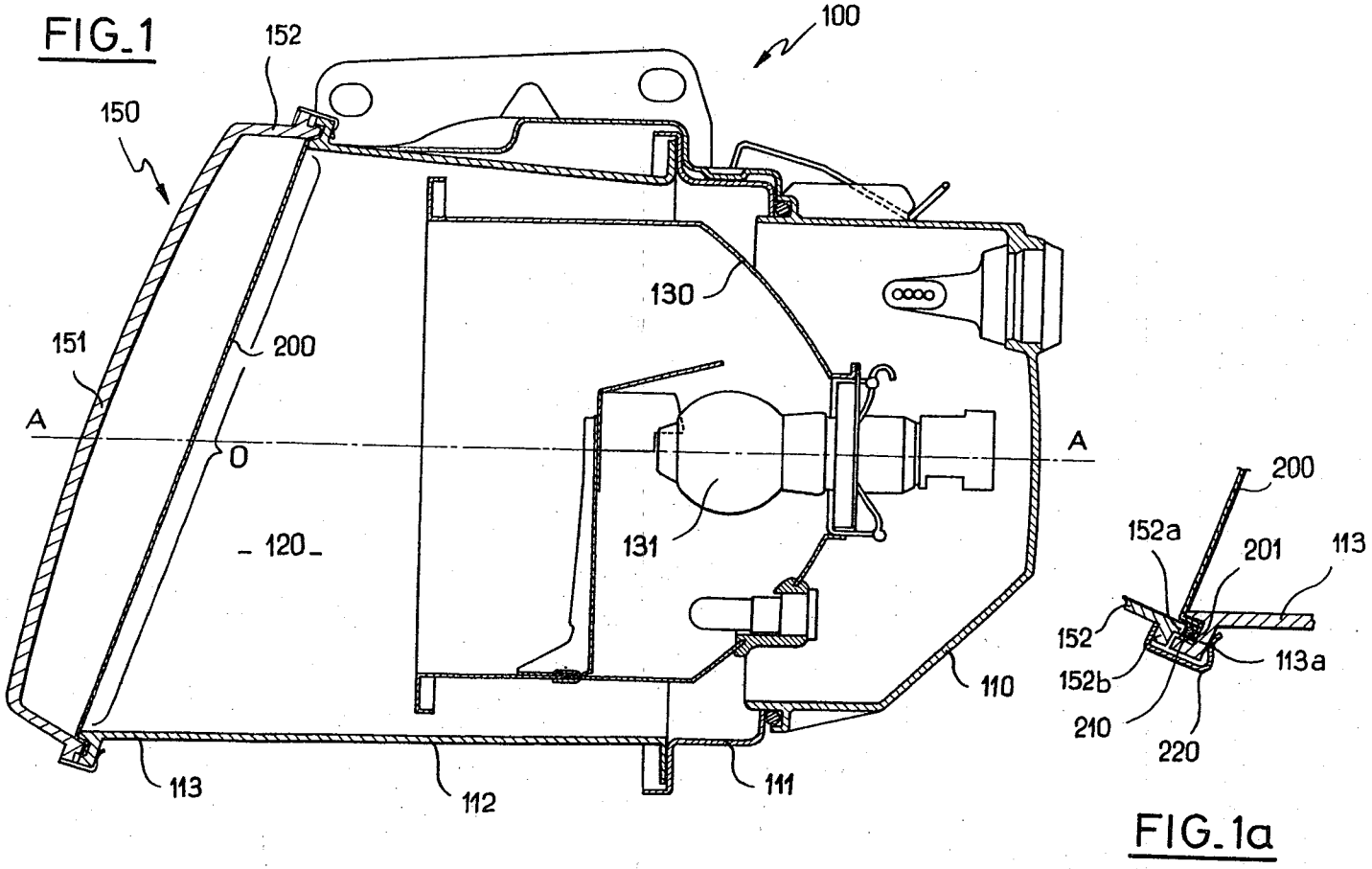
FIG. 1 is a view in vertical section of a motor vehicle headlamp embodying the invention.
FIG. 1*a* shows a detail of the edge of a lens and the edge of a protective screen of the headlamp, where they are secured to the edge of an outer shell of the headlamp.

FIG. 1 shows a headlamp 100 having a shell comprising a rear portion 110, an intermediate connecting portion 111 and a front, generally tube-like portion 112 which at its front end 113 defines an opening O through which the headlamp beam is projected. The chamber 120 bounded by the shell contains a reflector 130 supporting a bulb 131 and various other accessories required for the functioning of the headlamp. In operation, the light emitted by the bulb 131 is reflected by the reflector 130 through the opening O, generally parallel to the headlamp axis A–A.

The front opening O is closed by a lens 150 having a slightly convex central part 151 and a skirt 152 constituting the peripheral edge of the lens.

A continuous transparent (or at any rate translucent) screen 200 is interposed between the edge of the lens 150 and the edge of the opening O. The screen 200 is well separated from the lens 150, by the entire depth of the skirt 152.

More specifically, as shown in section in FIG. 1*a*, the front end 113 of the portion 112 has a peripheral rib or flange formed with a generally axially-facing peripheral groove 113*a*. The skirt 152 of the lens has a generally axially-directed rib 152*a* and a generally radially-directed rib or flange 152*b*. The screen 200 has a doubly folded edge 201. The assembly process is as follows: the folded edge 201 is fitted into the groove 113*a*, and then covered with a compressible annular seal 210. When the lens 150 is fitted, the rib 152*a* compresses the seal 210 on to the edge 201 in the groove 113*a*. A number of U-shaped clips 220 are then fitted to hold the components together by clipping on the flange 152*b* of the lens 150 and on the flange containing the groove 113*a*.

This manner of assembly gives a hermetically sealed assembly which can be dismantled.

The screen 200 is preferably made of a transparent thin plastics material, such as a methacrylate or a polycarbonate. It is preferably rigid but may alternatively be a resiliently deformable film. It is transparent or at least translucent and can be coloured, although its optical function is not a basic feature of the present invention.

The basic function of the screen 200 is as follows: if the lens 150 should break, for example as a result of a blow from a stone, or some other impact, the screen 200 should nearly always remain intact because of its distance from the central part 151 of the lens 150. The screen 200 prevents any broken glass, dust or moisture from entering the space 120, and there is no risk of the optical properties of the reflector 130 being impaired.

In the absence of a lens, the damaged headlamp can be used until the vehicle reaches a repair garage, whereupon the clips 220 can be released and the remains of the lens 150 replaced by a new lens, without removing the screen 200, so that space 120 is protected throughout against contamination.

In a modified form of headlamp embodying the invention, interchangeable sub-assemblies are used, each comprising a lens to the rear of which a screen of the previously described kind is attached, the screen and lens being held together around their periphery, for example by adhesive or by fitting together. In this modification, the lens and screen sub-assembly must be replaced if the lens should be broken, instead of replacing the lens alone.

In either case, after a lens has broken, all or most of the other headlamp components can be re-used without any risk of damage thereto, since the screen protects them against the broken glass of the lens and against any external contaminant.

What I claim as my invention and desire to secure by Letters Patent is:

1. A vehicle headlamp comprising:

a shell having a front opening through which a beam of light is projected when the headlamp is in use, the shell having a peripheral portion completely surrounding the opening, a lens completely closing the front opening of the shell, the lens having a peripheral mounting zone cooperable with the peripheral portion of the shell, and a substantially planar screen extending continuously over the entire front opening of the shell so as to completely cover that opening, the periphery of the screen being sandwiched between said lens mounting zone and said shell peripheral portion along the total circumferential extent of said mounting zone and peripheral portion, and the screen being imperforate and capable of transmitting light without distortion, whereby should the lens break, the interior of the shell remains closed and protected by the screen.

2. A headlamp according to claim 1, wherein one of said mounting zone of said lens and said portion of said shell has a groove around said opening, while the other of said mounting zone and said portion has a rib complementary to said groove, and said portion of said screen has a double fold, to allow said screen to fit between said rib and said groove.

3. A headlamp according to claim 2, wherein said portions of said shell and said screen and said mounting zone of said lens are held together by U-shaped clips, each straddling a flange portion of said lens and a flange portion of said shell.

4. A headlamp according to claim 1 or claim 2 or claim 3, wherein said portions of said shell and said screen and said mounting zone of said lens are clamped together with the interposition of at least one seal.

5. A headlamp according to claim 1 or claim 2 or claim 3, wherein said screen is of a rigid material.

6. A headlamp according to claim 1 or claim 2 or claim 3, wherein said screen is of a flexible, resiliently deformable material.

7. A headlamp according to claim 1, wherein said lens has a peripheral skirt which serves to space the major part of said lens from said screen.

8. A headlamp according to claim 1 or claim 7, wherein the part of said screen which closes said opening of said shell is planar, at least on the side of said screen facing said lens.

9. A headlamp according to claim 1, wherein said lens and said screen are secured together to form a sub-assembly.

* * * * *